US009955809B2

(12) United States Patent
de Guzman

(10) Patent No.: US 9,955,809 B2
(45) Date of Patent: May 1, 2018

(54) CUP SLEEVE WITH POCKET

(71) Applicant: Arnold Moises de Guzman, Santa Barbara, CA (US)

(72) Inventor: Arnold Moises de Guzman, Santa Barbara, CA (US)

( * ) Notice: Subject to any disclaimer, the term of this patent is extended or adjusted under 35 U.S.C. 154(b) by 34 days.

(21) Appl. No.: 15/058,107

(22) Filed: Mar. 1, 2016

(65) Prior Publication Data

US 2017/0071384 A1 Mar. 16, 2017

Related U.S. Application Data

(60) Provisional application No. 62/217,226, filed on Sep. 11, 2015.

(51) Int. Cl.
*B65D 1/40* (2006.01)
*A47G 23/02* (2006.01)
(Continued)

(52) U.S. Cl.
CPC ..... *A47G 23/0216* (2013.01); *B65D 25/205* (2013.01); *B65D 81/3881* (2013.01); *A47G 21/16* (2013.01)

(58) Field of Classification Search
CPC ..... A47G 23/0216; A47G 11/001; A47G 23/0241; B65D 81/3876; B65D 81/3874; B65D 3/22
See application file for complete search history.

(56) References Cited

U.S. PATENT DOCUMENTS 2,920,804 A 1/1969 Minton
5,109,588 A 5/1992 Hewlett et al.
(Continued)

FOREIGN PATENT DOCUMENTS

KR 101 613 402 B1 4/2016
WO WO 2011/063836 A1 6/2011

OTHER PUBLICATIONS

NPL1: Communication (Extended European Search Report) dated Jan. 26, 2017 for European Patent Application No. 16188214.7-1653 by Applicant Arnold M. De Guzman.
(Continued)

*Primary Examiner* — Shawn M Braden

(57) ABSTRACT

In an embodiment of the invention, an apparatus comprises: a first sleeve body and a second sleeve body, wherein the first sleeve body comprises a first sleeve body outer wall and a first sleeve body opening, wherein the first sleeve body opening is configured to removably receive a cup, wherein the first sleeve body outer wall comprises a first sleeve body outer wall portion, wherein the second sleeve body comprises a second sleeve body inner wall, wherein the second sleeve body inner wall comprises a second sleeve body inner wall portion, and wherein the second sleeve body inner wall portion is coupled to the first sleeve body outer wall portion. In another embodiment of the invention, a method comprises: forming a first sleeve body; forming a second sleeve body; wherein the first sleeve body comprises a first sleeve body outer wall and a first sleeve body opening, wherein the first sleeve body opening is configured to removably receive a cup; wherein the first sleeve body outer wall comprises a first sleeve body outer wall portion; wherein the second sleeve body comprises a second sleeve body inner wall; wherein the second sleeve body inner wall comprises a second sleeve body inner wall portion; and coupling the second sleeve body inner wall portion to the first sleeve body outer wall portion.

8 Claims, 18 Drawing Sheets

(51) Int. Cl.

| | |
|---|---|
| ***B65D 81/38*** | (2006.01) |
| ***B65D 25/20*** | (2006.01) |
| *A47G 21/16* | (2006.01) |

(56) References Cited

U.S. PATENT DOCUMENTS

| | | | | |
|---|---|---|---|---|
| 5,205,473 | A | 4/1993 | Coffin, Sr. | |
| 5,222,656 | A | 6/1993 | Carlson | |
| 5,425,497 | A | 6/1995 | Sorensen | |
| D399,707 | S | 10/1998 | Villarreal, Jr. et al. | |
| 5,857,615 | A | 1/1999 | Rose | |
| 6,286,709 | B1 | 9/2001 | Hudson | |
| 6,286,754 | B1 * | 9/2001 | Stier | B65D 81/3881 220/738 |
| 6,374,540 | B1 * | 4/2002 | Garcia | A47G 7/085 47/72 |
| 6,749,082 | B1 * | 6/2004 | Nickel | B65D 3/22 220/738 |
| 7,614,523 | B1 * | 11/2009 | Fixler | A47G 23/0216 215/392 |
| 2007/0128316 | A1 * | 6/2007 | Bilyea | A47G 23/0216 426/77 |

OTHER PUBLICATIONS

NPL: Notice of Allowance & Notice of Allowability dated Jul. 7, 2017 for U.S. Appl. No. 29/556,587 by Applicant Arnold M. De Guzman.

* cited by examiner

CUP SLEEVE WITH POCKET

CROSS-REFERENCE(S) TO RELATED APPLICATIONS

This application claims the benefit of and priority to U.S. Provisional Application 62/217,226, filed 11 Sep. 2015 and entitled Cup Sleeve With Pocket. This U.S. Provisional Application 62/217,226 is hereby fully incorporated herein by reference.

FIELD

Embodiments of the invention relate generally to cups sleeves or cup jackets.

DESCRIPTION OF RELATED ART

The background description provided herein is for the purpose of generally presenting the context of the disclosure of the invention. Work of the presently named inventor, to the extent the work is described in this background section, as well as aspects of the description that may not otherwise qualify as prior art at the time of filing, are neither expressly nor impliedly admitted as prior art against this present disclosure of the invention.

Cup sleeves, otherwise commonly known as cup jackets, are used to protect the hands of individuals who are holding a cup filled with hot liquid such as, for example, hot coffee, hot tea, hot water, or another type of hot beverage. One example of a cup jacket is disclosed in U.S. Pat. No. 5,425,497.

However, there is a continuing need for improvements in cup sleeves.

SUMMARY

In an embodiment of the invention, an apparatus comprises: a first sleeve body and a second sleeve body, wherein the first sleeve body comprises a first sleeve body outer wall and a first sleeve body opening, wherein the first sleeve body opening is configured to removably receive a cup, wherein the first sleeve body outer wall comprises a first sleeve body outer wall portion, wherein the second sleeve body comprises a second sleeve body inner wall, wherein the second sleeve body inner wall comprises a second sleeve body inner wall portion, and wherein the second sleeve body inner wall portion is coupled to the first sleeve body outer wall portion.

In another embodiment of the invention, a method comprises: forming a first sleeve body; forming a second sleeve body; wherein the first sleeve body comprises a first sleeve body outer wall and a first sleeve body opening, wherein the first sleeve body opening is configured to removably receive a cup; wherein the first sleeve body outer wall comprises a first sleeve body outer wall portion; wherein the second sleeve body comprises a second sleeve body inner wall; wherein the second sleeve body inner wall comprises a second sleeve body inner wall portion; and coupling the second sleeve body inner wall portion to the first sleeve body outer wall portion.

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the invention and together with the description, serve to explain the principles of the invention.

BRIEF DESCRIPTION OF DRAWINGS

Non-limiting and non-exhaustive embodiments of the present invention are described with reference to the following figures, wherein like reference numerals refer to like parts throughout the various views unless otherwise specified.

It is to be noted, however, that the appended drawings illustrate only typical embodiments of this invention and are therefore not to be considered limiting of its scope, for the present invention may admit to other equally effective embodiments.

DETAILED DESCRIPTION

Figure 1:
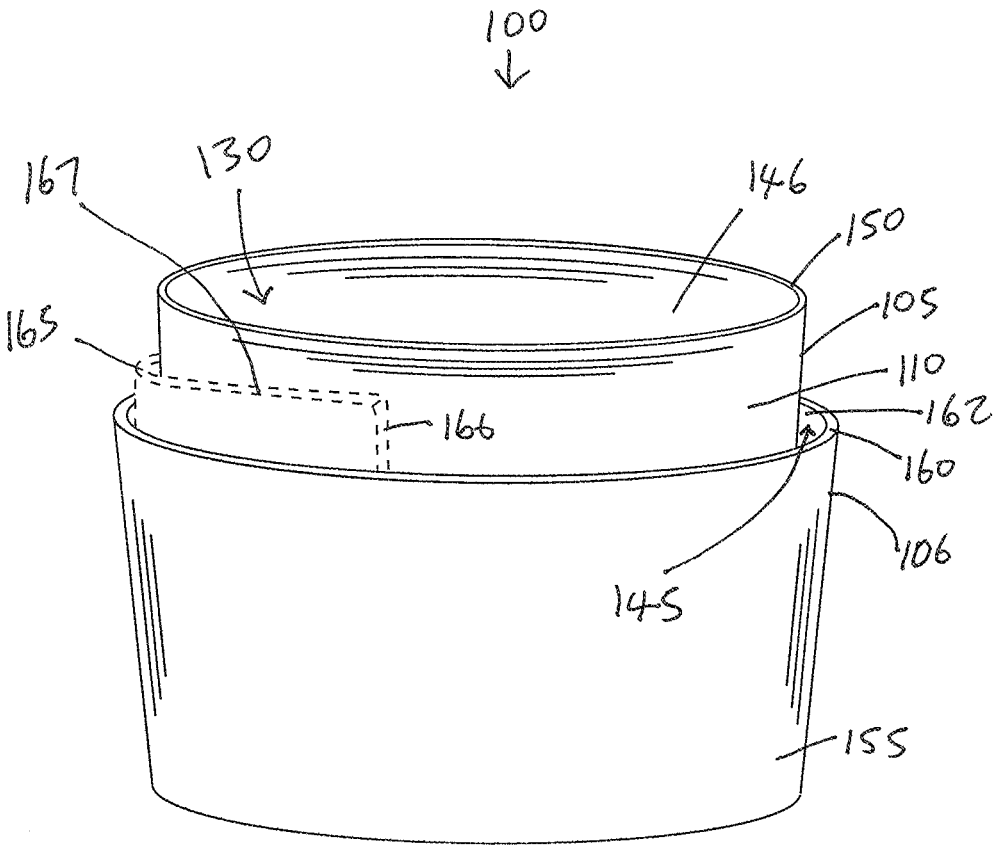
FIG. 1 is a side perspective view of an apparatus (cup sleeve), in accordance with an embodiment of the invention.

In the following detailed description, for purposes of explanation, numerous specific details are set forth to provide a thorough understanding of the various embodiments of the present invention. Those of ordinary skill in the art will realize that these various embodiments of the present invention are illustrative only and are not intended to be limiting in any way. Other embodiments of the present invention will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual implementation, numerous implementation-specific decisions may be required to achieve specific design objectives. These design objectives will vary from one implementation to another and from one developer to another. Moreover, it will be appreciated that such a development effort might be complex and time-consuming, but would nevertheless be a routine engineering undertaking for those of ordinary skill in the art having the benefit of this disclosure. The various embodiments disclosed herein are not intended to limit the scope and spirit of the herein disclosure.

Exemplary embodiments for carrying out the principles of the present invention are described herein with reference to the drawings. However, the present invention is not limited to the specifically described and illustrated embodiments. A person skilled in the art will appreciate that many other embodiments are possible without deviating from the basic concept of the invention. Therefore, the principles of the present invention extend to any work that falls within the scope of the appended claims.

In the description herein, numerous specific details are provided, such as examples of components, materials, parts, structures, and/or methods, to provide a thorough understanding of embodiments of the invention. One skilled in the relevant art will recognize, however, that an embodiment of the invention can be practiced without one or more of the specific details, or with other apparatus, systems, methods, components, materials, parts, structures, and/or the like. In other instances, well-known components, materials, parts, structures, methods, or operations are not shown or described in detail to avoid obscuring aspects of embodiments of the invention. Additionally, the figures are representative in nature and their shapes are not intended to illustrate the precise shape or precise size of any element and are not intended to limit the scope of the invention.

Those skilled in the art will understand that when an element or part in the drawings is referred to as being "on" (or "connected" to or "coupled" to or "attached" to) another element, it can be directly on (or directly attached to) the other element or intervening elements may also be present. Furthermore, relative terms such as "inner", "outer", "upper", "above", "lower", "beneath", "below", "downward", and "upward" and similar terms, may be used herein to describe a relationship of one element relative to another element. It is understood that these terms are intended to encompass different orientations of the device in addition to the orientation depicted in the figures.

Although the terms first, second, and the like may be used herein to describe various elements, components, parts, regions, layers, chambers, and/or sections, these elements, components, parts, regions, layers, chambers, edges, body or bodies, portions, and/or sections should not be limited by these terms. These terms are only used to distinguish one element, component, part, region, layer, chamber, edge, body, portion, or section from another element, component, part, region, layer, chamber, edge, body, portion, or section. Thus, a first element, component, part, region, layer, chamber, edge, body, portion, or section discussed below could be termed a second element, component, part, region, layer, chamber, edge, body, portion, or section without departing from the teachings of the present invention.

Embodiments of the invention are described herein with reference to cross-sectional view illustrations that are schematic illustrations of representative embodiments of the invention. As such, variations from the shapes of the illustrations as a result of, for example, manufacturing techniques and/or tolerances are expected. Embodiments of the invention should not be construed as limited to the particular shapes of the regions, elements, components, parts, layers, chambers, edges, body or bodies, portions, and/or sections illustrated herein but are to include deviations in shapes that result, for example, from manufacturing or particular implementations. For example, an element illustrated or described as square or oval or elliptical or rectangular may typically have rounded or curved features due to normal manufacturing tolerances or due to a particular implementation. Thus, the elements illustrated in the figures are schematic in nature and their shapes are not intended to illustrate the precise shape of an element of a device and are not intended to limit the scope of the invention.

As used herein, the terms "a" and "an" herein do not denote a limitation of quantity, but rather denote the presence of at least one of the referenced items.

In the following description and in the claims, the terms "include" and "comprise" are used in an open-ended fashion, and thus should be interpreted to mean "include, but not limited to . . . ". Also, the term "couple" (or "coupled") is intended to mean either an indirect or direct connection. Accordingly, if one device or component or element is coupled to another device or component or element, then that connection may be through a direct connection, or through an indirect connection via other devices or components or elements and/or other connections.

FIG. 1 is a side perspective view of an apparatus 100 (cup sleeve 100), in accordance with an embodiment of the invention. For example, FIG. 1 is a side perspective view of the left side of the apparatus 100. The apparatus 100 comprises: a first sleeve body 105 and a second sleeve body 106, wherein the first sleeve body 105 comprises a first sleeve body outer wall 110 and a first sleeve body opening 130, wherein the first sleeve body opening 130 is configured to removably receive a cup (e.g., cup 1500 in FIG. 15), wherein the first sleeve body outer wall 110 comprises a first sleeve body outer wall portion 1705 (FIG. 17), wherein the second sleeve body 106 comprises a second sleeve body inner wall 145, wherein the second sleeve body inner wall 145 comprises a second sleeve body inner wall portion 1710 (FIG. 17), and wherein the second sleeve body inner wall portion 1710 is coupled to the first sleeve body outer wall portion 1705.

In an embodiment of the invention, the height H1 of the sleeve body 105 and the height H2 of the sleeve body 106 are the same (i.e., body 105 and body 106 have the same width). In another embodiment of the invention, the height H1 (i.e., width) of the sleeve body 105 is greater than the height H2 (i.e., width) of the sleeve body 106. In other words, the first sleeve body 105 comprises a first height and the second sleeve body 106 comprises a second height, wherein the first height and second height are equal, in one embodiment of the invention. In another embodiment of the invention, the first sleeve body 105 comprises a first height and the second sleeve body 106 comprises a second height, wherein the first height is greater than the second height.

The first sleeve body 105 comprises the first sleeve body outer wall 110, a first sleeve body inner wall 146, a first sleeve body top edge 150, and a first sleeve body bottom edge 1305 (FIG. 13), wherein the first sleeve body outer wall 110 and the first sleeve body inner wall 146 are between the first sleeve body top edge 150 and the first sleeve body bottom edge 1305, and wherein the first sleeve body inner wall 146 defines (or forms) the first sleeve body opening 130 that is configured to removably receive a cup. A first element is configured to removably receive a second element if the second element can also be subsequently removed from or subsequently separated from the first element.

In an embodiment of the invention, the first sleeve body 105 and second sleeve body 106 comprise the same type of material. In another embodiment of the invention, the first sleeve body 105 comprises a first type material and the second sleeve body 106 comprises a second type of material, wherein the first type of material and the second type of material are different materials.

In an embodiment of the invention, the first sleeve body 105 and/or the second sleeve body 106 comprise a disposable material or a bio-degradable material. In another embodiment of the invention, the first sleeve body 105 and/or the second sleeve body 106 comprise a recyclable material.

In an embodiment of the invention, the first sleeve body 105 and/or the second sleeve body 106 comprise a paper material, a rigid paper material such as cartons, a paper pulp, a silicone material, another type of rubber material, plastic, or another type of synthetic material.

In an embodiment of the invention, the first sleeve body 105 and/or the second sleeve body 106 comprise a heat insulator such as, for example, a material that comprises a dielectric material that can prevent heat transmission from a hot liquid in a cup to the hands of the holder of the first sleeve body 105 and/or the second sleeve body 106.

In an embodiment of the invention, the second sleeve body 106 comprises a second sleeve body outer wall 155, the second sleeve body inner wall 145, a second sleeve body top edge 160, and a second sleeve body bottom edge 1310 (FIG. 13), wherein the second sleeve body outer wall 155 and the second sleeve body inner wall 145 are between the second sleeve body top edge 160 and the second sleeve body bottom edge 1310, wherein the second sleeve body inner wall 145 defines (or forms) a pocket opening 162 (second sleeve body opening 162 or gap 162) that can removably receive and that can removably hold an object 165. Therefore, the object 162 is removably inserted into the gap 162. The left front edge 166 of the object 165 is also shown as partly disposed in the pocket opening 162. Therefore, the pocket opening 162 is between (or/and is defined by or/and is formed by) the second sleeve body inner wall 145 and the first sleeve body outer wall 110. The pocket opening 162 is also disposed between the second sleeve body top edge 160 and the intersection area 1715 (FIG. 17) wherein the portions 1705 and 1710 are coupled together (and/or are attached together and/or are in contact together) at the intersection area 1715.

The first sleeve body outer wall 110 is on an opposite side of the first sleeve body inner wall 146. The second sleeve body outer wall 155 is on an opposite side of the second sleeve body inner wall 145.

The object 165 can be a disposable material or a bio-degradable material or a recyclable material. For example, the object 165 can be a napkin or other paper material. The object 165 can also be another type of material such as, by way of example, a plastic or rubber material. The object 165 can also have an advertisement or logo or text that provides a reminder or advertisement to a user of the cup sleeve 100 (apparatus 100).

A user of the cup sleeve 100 can easily grab the object 165 and pull the object 165 away and out of the pocket opening 162 and out of the second sleeve body 106 or can easily insert the object 165 into the pocket opening 162 of the second sleeve body 106. For example, the top edge 167 of the object 165 is above the second sleeve body top edge 160 and is not disposed within the pocket opening 162, and, therefore, the user can conveniently grab the top edge 167 and pull the object 165 away and out of the pocket opening 162 and out of the second sleeve body 106. Therefore, the second sleeve body 106 provides an advantage of removably securing objects 165 for the convenience of the user of the cup sleeve 100.

In an embodiment of the invention, the first sleeve body outer wall portion 1705 and second sleeve body inner wall portion 1710 (FIG. 17) are coupled (or attached) to each other at the intersection 1715. Therefore, the second sleeve body 106 is at least partly coupled to the first sleeve body 105 at the intersection 1715. The second sleeve body inner wall portion 1710 may be coupled to the first sleeve body outer wall portion 1705 by, for example, adhesives, bonding, stitching, snap-on components, buttons, or by use of other conventional attachment methods known to those skilled in the art. In another embodiment of the invention, the second sleeve body inner wall portion 1710 may be coupled to the first sleeve body outer wall portion 1705 so that second sleeve body inner wall portion 1710 is integral to the first sleeve body outer wall portion 1705. The second sleeve body inner wall portion 1710 and first sleeve body outer wall portion 1705 can be made integral by use of, by way of example, conventional molding manufacturing techniques known to those skilled in the art.

In an embodiment of the invention, the size, configuration, and/or shape of the pocket opening 162 may vary as long as the pocket opening 162 can removably receive and removably hold or removably secure the object 165.

Figure 2:
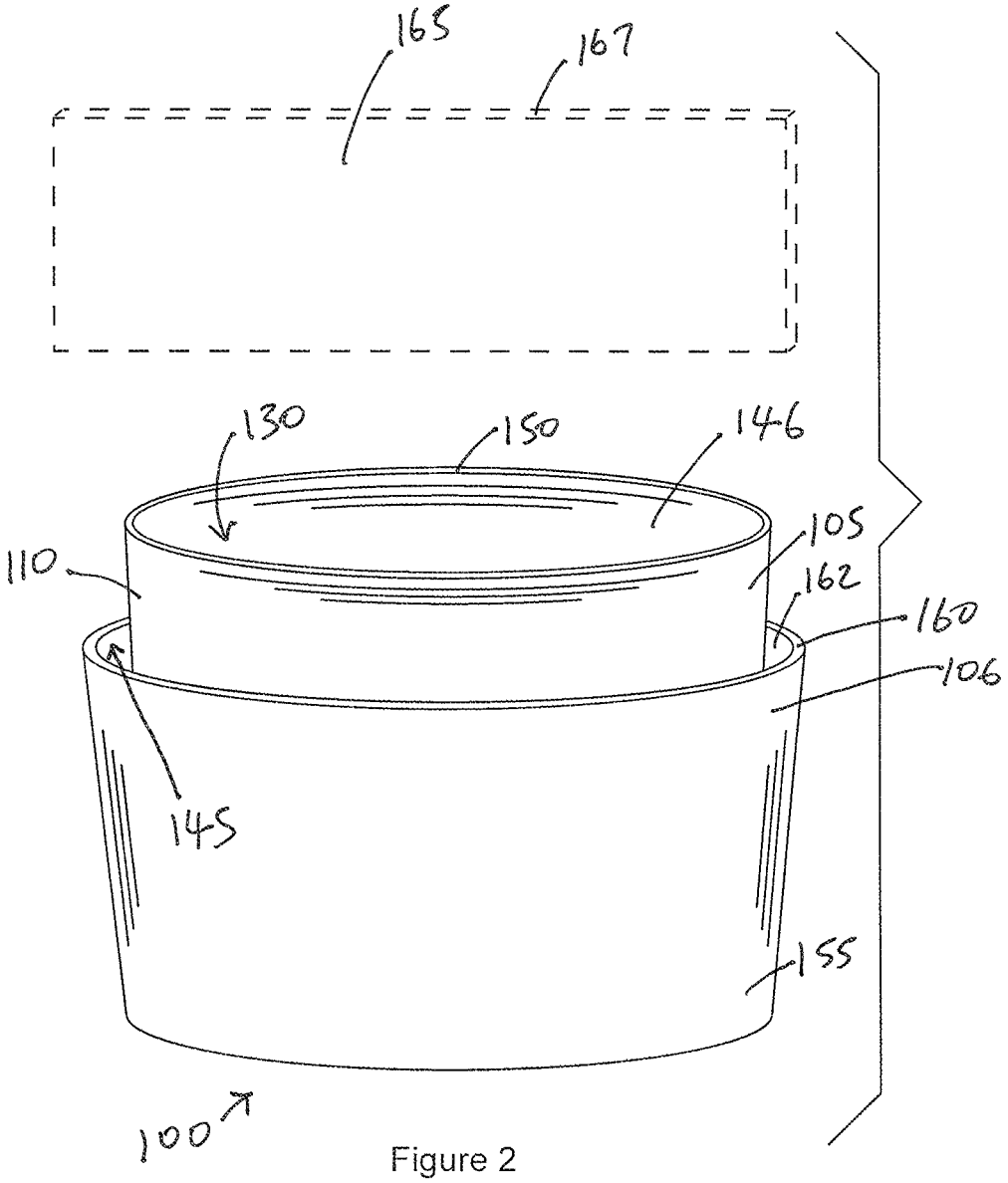
FIG. 2 is another side perspective view of an apparatus, in accordance with an embodiment of the invention.

FIG. 2 is another side perspective view of an apparatus 100, in accordance with an embodiment of the invention. As shown, the object 165 is removed from and is not inserted in the pocket opening 162 of the second sleeve body 106 of the cup sleeve 100.

Figure 3:
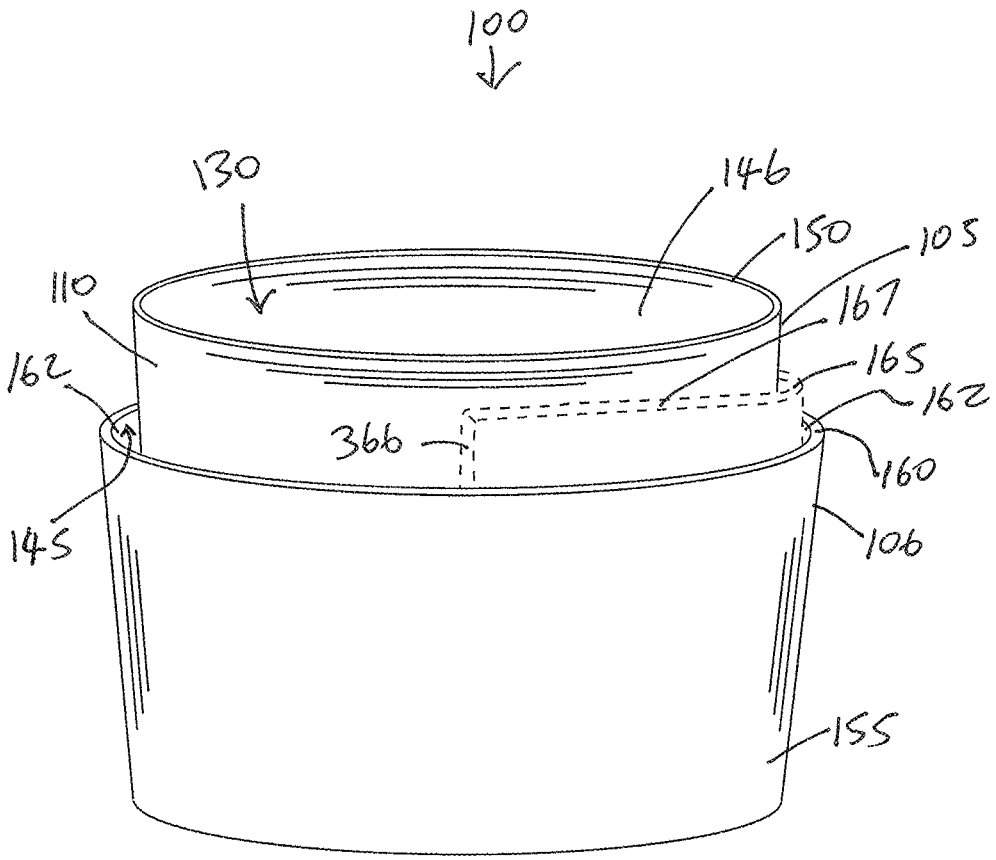
FIG. 3 is another side perspective view of an apparatus, in accordance with an embodiment of the invention.

FIG. 3 is another side perspective view of an apparatus 100, in accordance with an embodiment of the invention. For example, FIG. 3 is a side perspective view of the right side of the apparatus 100. In contrast, the view in FIG. 1 is a left side perspective view of the cup sleeve 100. Additionally, FIG. 3 also shows the object 165 that is removably inserted and removably disposed in the pocket opening 162 of the second sleeve body 106. The right front edge 366 of the object 165 is also shown as partly disposed in the pocket opening 162.

Figure 4:
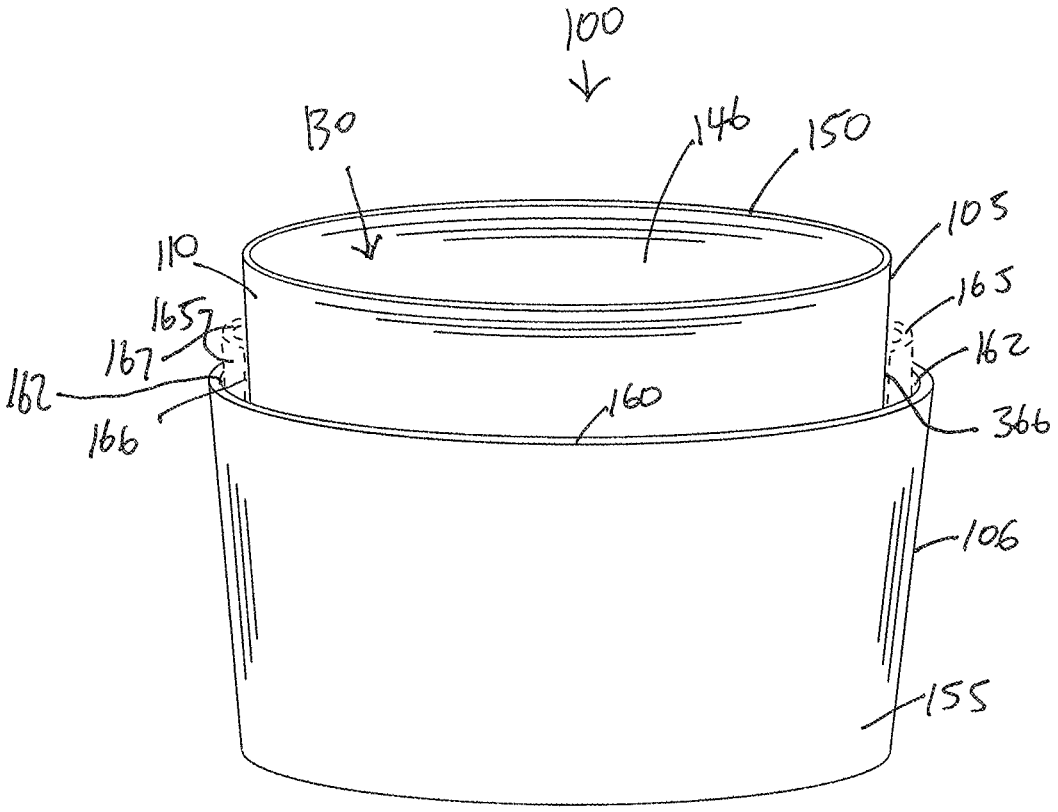
FIG. 4 is another side perspective view of an apparatus, in accordance with an embodiment of the invention.

FIG. 4 is another side perspective view of an apparatus 100, in accordance with an embodiment of the invention. For example, FIG. 4 is a side perspective view of the front side of the apparatus 100. Additionally, FIG. 4 also shows the object 165 that is removably inserted and removably disposed in the pocket opening 162 of the second sleeve body 106. The left front edge 166 and right front edge 366 of the object 165 are also shown as partly disposed in the pocket opening 162.

Figure 5:
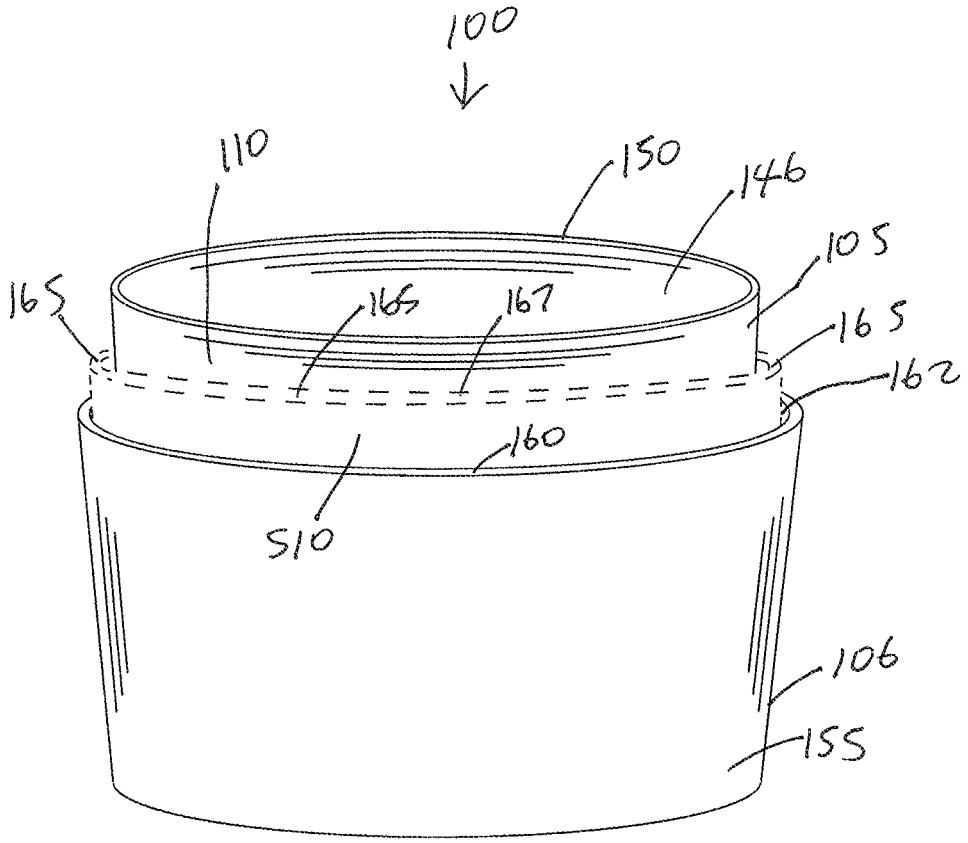
FIG. 5 is another side perspective view of an apparatus, in accordance with an embodiment of the invention.

FIG. 5 is another side perspective view of an apparatus 100, in accordance with an embodiment of the invention. For example, FIG. 5 is a side perspective view of the rear side of the apparatus 100. Additionally, FIG. 5 also shows the object 165 that is removably inserted and removably disposed in the pocket opening 162 of the second sleeve body 106. The middle part 505 of the object 165 is seen in this rear side perspective view of the apparatus 100, and this middle part 505 is partly disposed in the pocket opening 162.

The first sleeve body top edge 150 and the first sleeve body bottom edge 1305 can be straight or linear in shape or can be arcuate (bow configuration) in shape. The second sleeve body top edge 160 and the second sleeve body bottom edge 1310 can be straight or linear in shape or can be arcuate (bow configuration) in shape.

Figure 6:
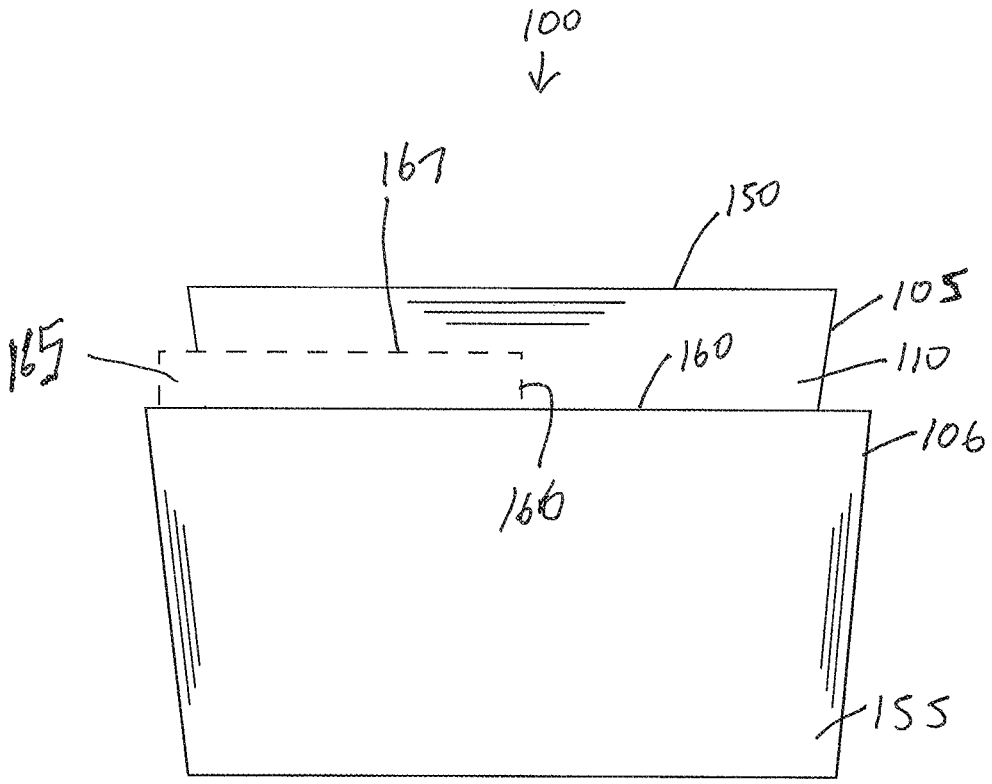
FIG. 6 is a side elevational view of an apparatus, in accordance with an embodiment of the invention.

FIG. 6 is a side elevational view of an apparatus 100, in accordance with an embodiment of the invention. For example, FIG. 6 is a side elevational view of the left side of the apparatus 100. Additionally, FIG. 6 also shows the object 165 that is removably inserted and removably disposed in the pocket opening 162 of the second sleeve body 106.

Figure 7:
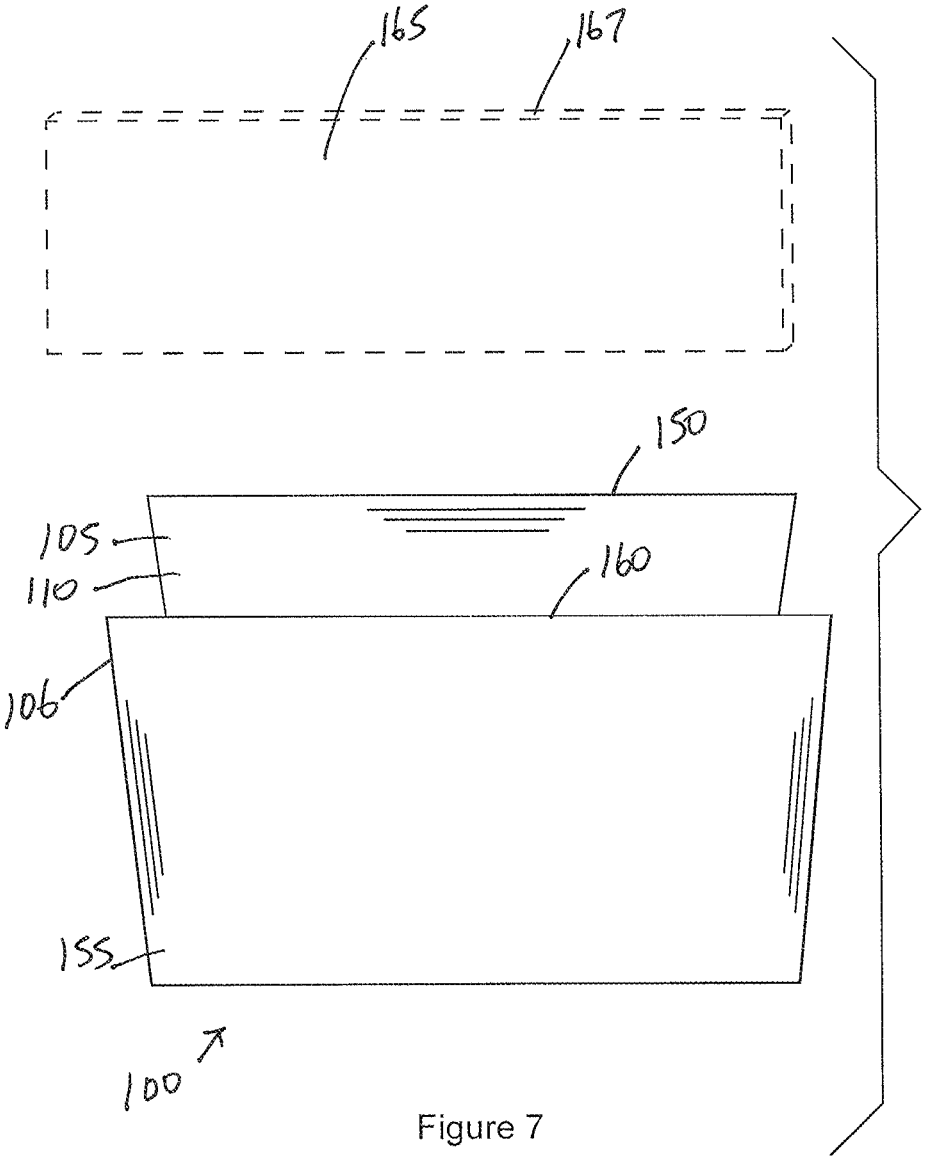
FIG. 7 is another side elevational view of an apparatus, in accordance with an embodiment of the invention.

FIG. 7 is another side elevational view of an apparatus 100, in accordance with an embodiment of the invention. As shown, the object 165 is removed from and is not inserted in the pocket opening 162 of the second sleeve body 106 of the cup sleeve 100 in this side elevational view of the cup sleeve 100.

Figure 8:
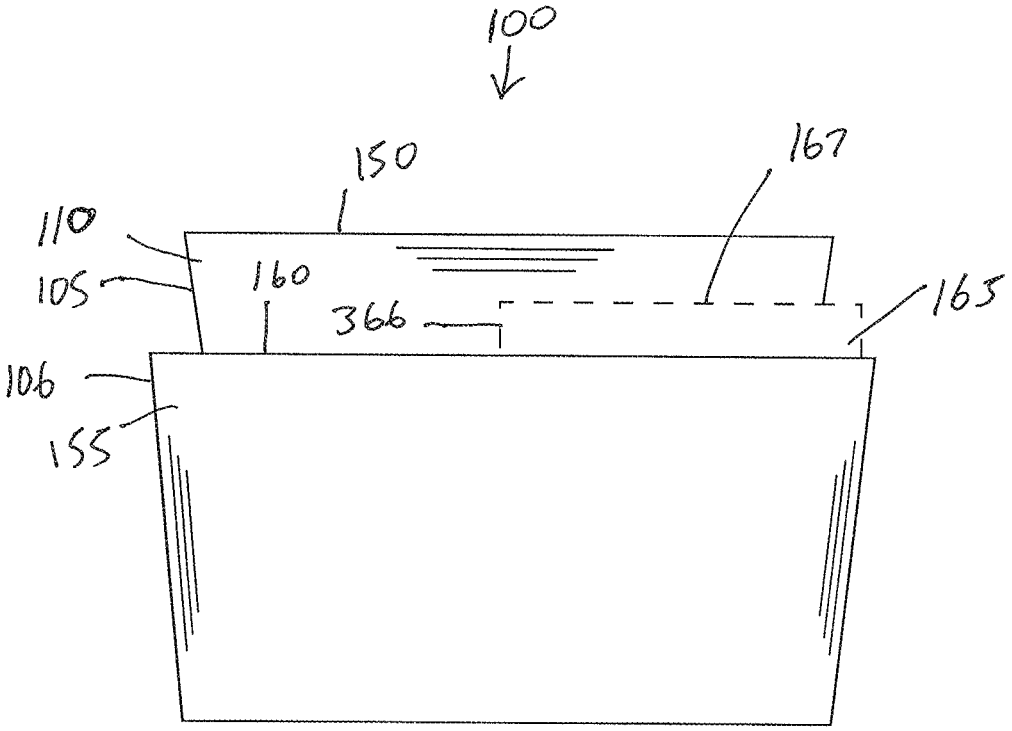
FIG. 8 is another side elevational view of an apparatus, in accordance with an embodiment of the invention.

FIG. 8 is another side elevational view of an apparatus 100, in accordance with an embodiment of the invention. For example, FIG. 8 is a side elevational view of the right side of the apparatus 100. Additionally, FIG. 8 also shows the object 165 that is removably inserted and removably disposed in the pocket opening 162 of the second sleeve body 106.

Figure 9:
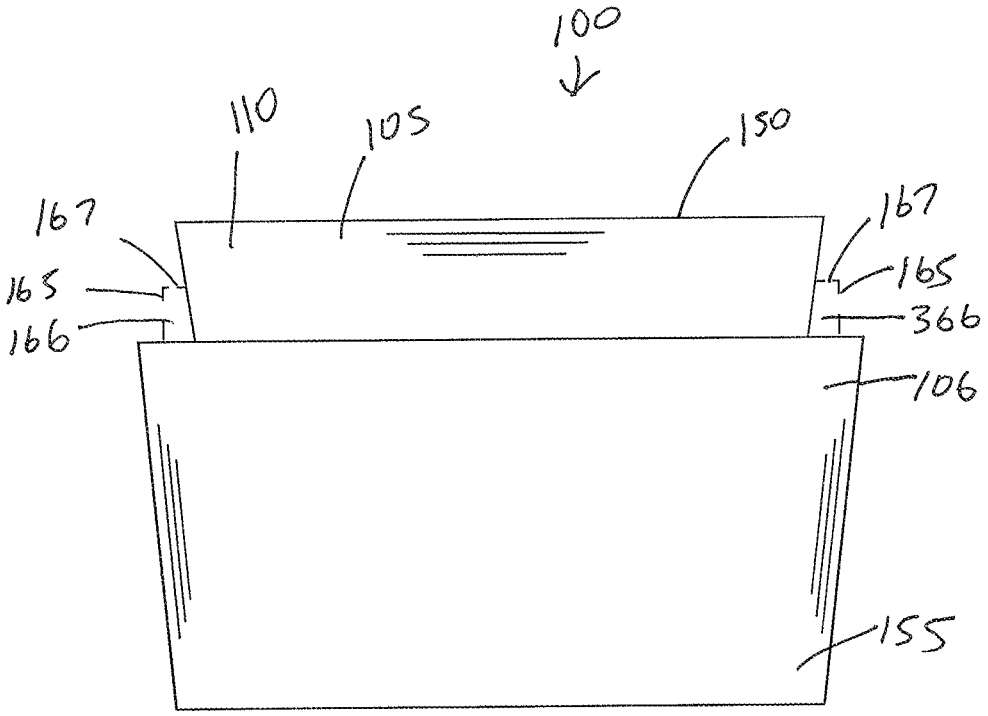
FIG. 9 is another side elevational view of an apparatus, in accordance with an embodiment of the invention.

FIG. 9 is another side elevational view of an apparatus 100, in accordance with an embodiment of the invention. For example, FIG. 9 is a side elevational view of the front side of the apparatus 100. Additionally, FIG. 9 also shows the object 165 that is removably inserted and removably disposed in the pocket opening 162 of the second sleeve body 106. The left front edge 166 and right front edge 366 of the object 165 are also shown as partly disposed in the pocket opening 162.

Figure 10:
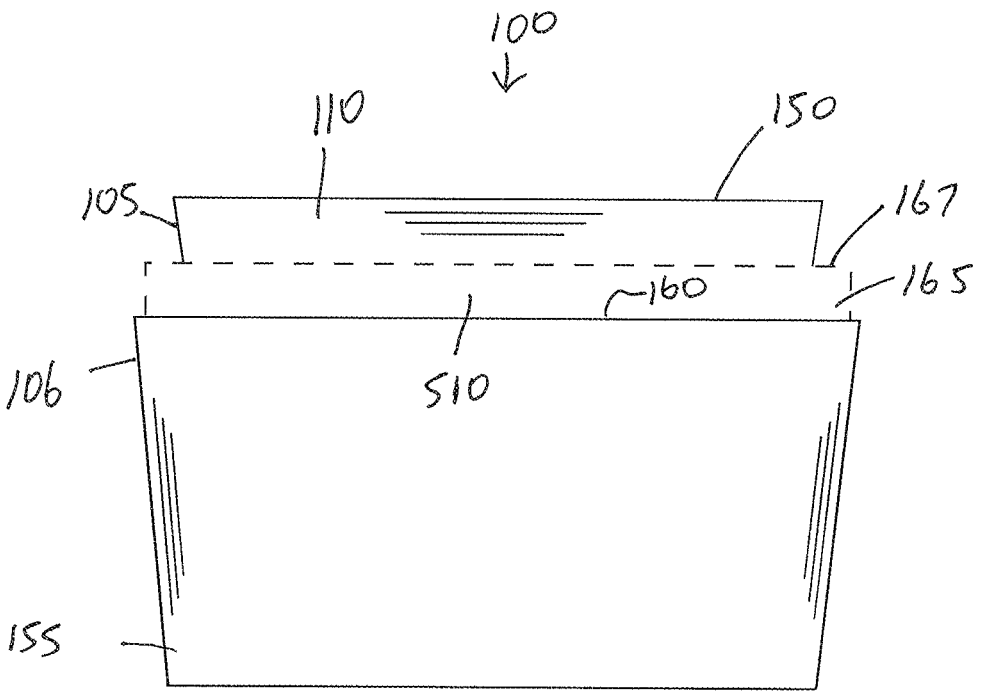
FIG. 10 is another side elevational view of an apparatus, in accordance with an embodiment of the invention.

FIG. 10 is another side elevational view of an apparatus 100, in accordance with an embodiment of the invention. For example, FIG. 10 is a side elevational view of the rear side of the apparatus 100. Additionally, FIG. 10 also shows the object 165 that is removably inserted and removably disposed in the pocket opening 162 of the second sleeve body 106.

Figure 11:
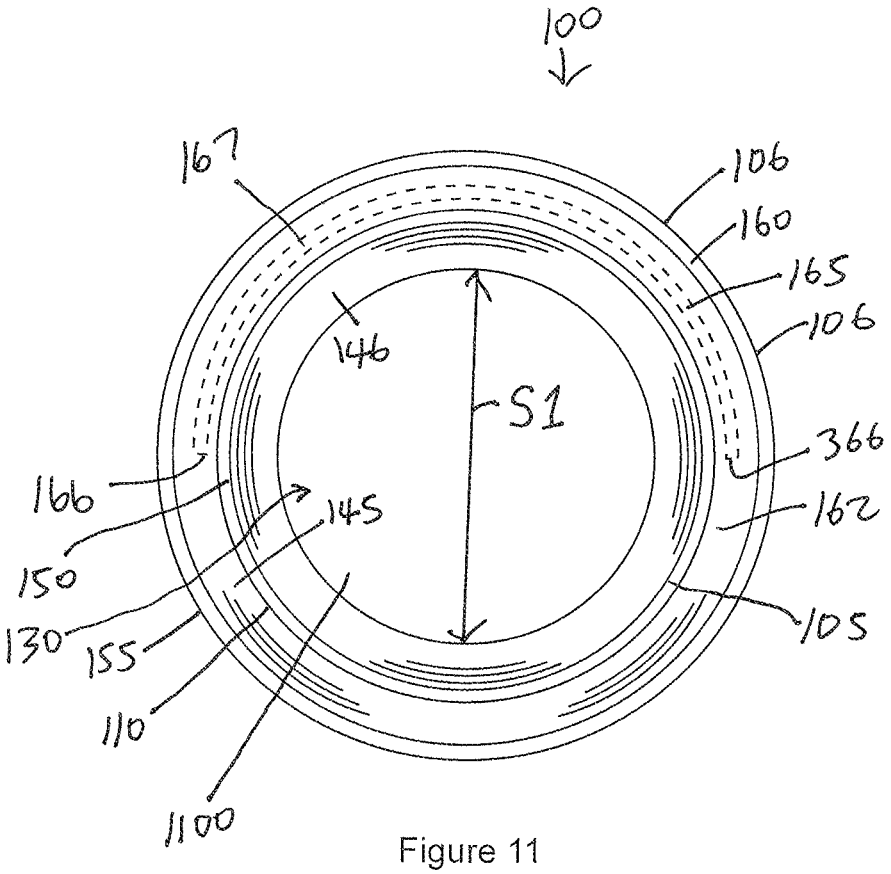
FIG. 11 is a top elevational view of an apparatus, in accordance with an embodiment of the invention.

FIG. 11 is a top elevational view of an apparatus 100, in accordance with an embodiment of the invention. FIG. 11 also shows the object 165 that is removably inserted and removably disposed in the pocket opening 162 of the second sleeve body 106 of the apparatus 100 in this top elevational view of the apparatus 100 (cup sleeve 100).

In an embodiment of the invention, the first sleeve body opening 130 has a first sleeve body top portion opening 1100 with a size S1 which can be a radius or any measurement that defines the size of the first sleeve body top portion opening 1100.

The pocket opening 162 is concentric to the outer wall 110 and to the inner wall 145 and the pocket opening 162 is a gap that is disposed between the outer wall 110 an inner wall 145. The pocket opening 162 extends in a circumference around the outer wall 110 and inner wall 145. The inner wall 145 surrounds the pocket opening 162 and outer wall 110. The inner wall 146 surrounds the opening 130. The inner wall 146 is between the opening 130 and the pocket opening 162. The inner wall 146 is also between the opening 130 and the outer wall 110. The inner wall 145 is between the outer wall 110 and the outer wall 155. The inner wall 145 is also between the pocket opening 162 and the outer wall 155.

Figure 12:
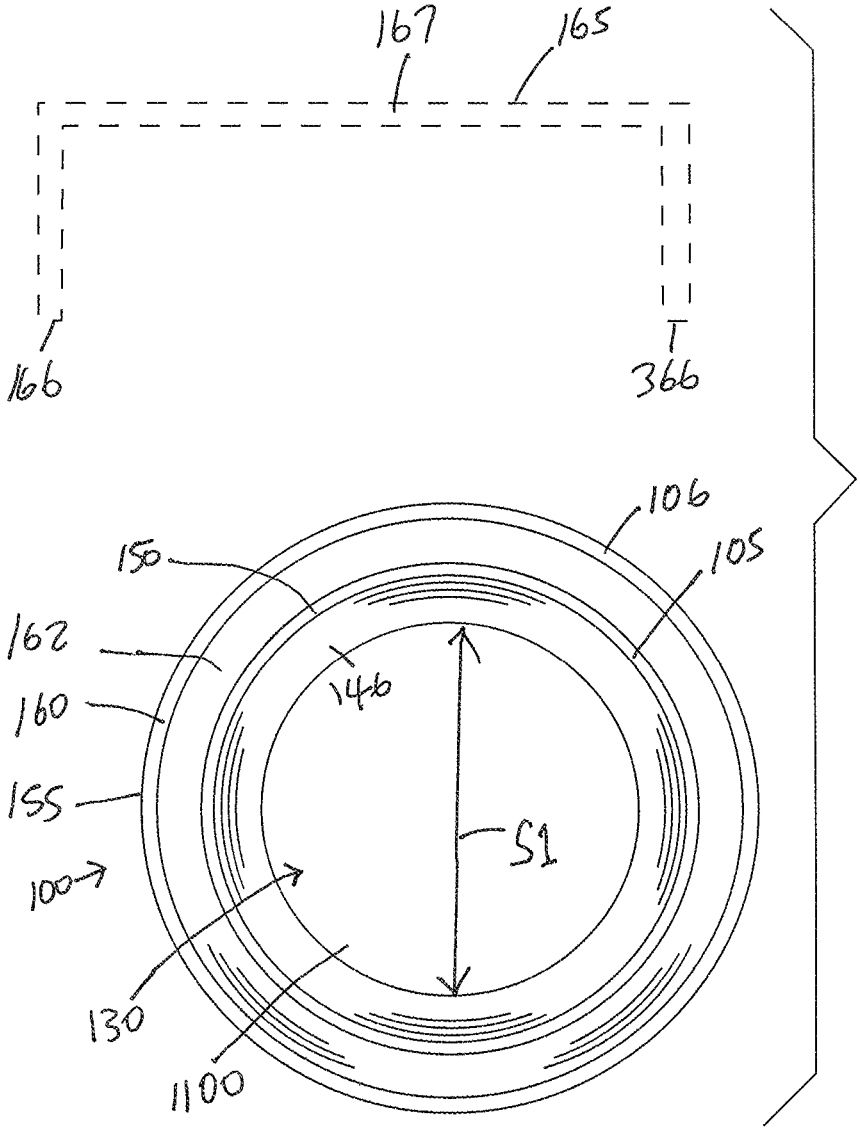
FIG. 12 is another top elevational view of an apparatus, in accordance with an embodiment of the invention.

FIG. 12 is another top elevational view of an apparatus 100, in accordance with an embodiment of the invention. As shown in FIG. 12, the object 165 is removed from and is not inserted in the pocket opening 162 of the second sleeve body 106 of the cup sleeve 100 in this top elevational view of the cup sleeve 100.

Figure 13:
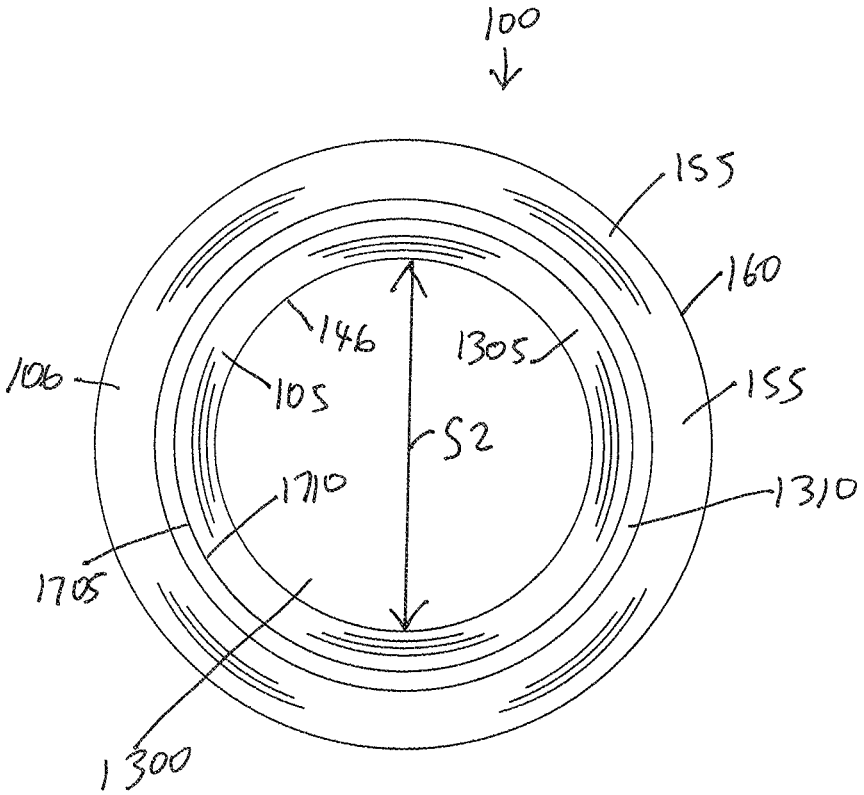
FIG. 13 is a bottom elevational view of an apparatus, in accordance with an embodiment of the invention.

FIG. 13 is a bottom elevational view of an apparatus 100, in accordance with an embodiment of the invention. In an embodiment of the invention, the first sleeve body opening 130 has a first sleeve body bottom portion opening 1300 with a size S2 which can be a radius or any measurement that defines the size of the first sleeve body bottom portion opening 1300. The size S2 can be equal to the size S1, or the size S2 can be smaller than the size S1. As also shown in FIG. 13, the wall portion 1710 is coupled to the wall portion 1705 and the wall portion 1710 surrounds the wall portion 1705. The wall portion 1710 is also concentric with the wall portion 1705.

Figure 14:
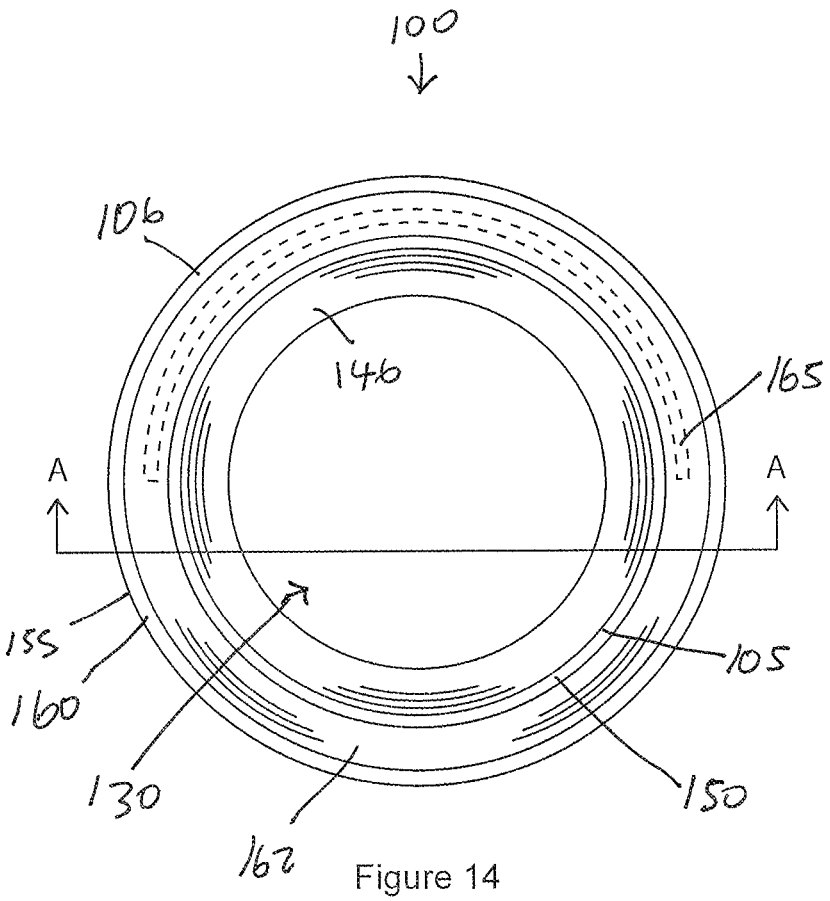
FIG. 14 is another top elevational view of an apparatus, in accordance with an embodiment of the invention.

FIG. 14 is another top elevational view of an apparatus 100, in accordance with an embodiment of the invention. A reference line A-A is also shown in FIG. 14. The reference line A-A is used in reference to the cross sectional side elevational view of the apparatus 100 as shown in FIG. 17.

Figure 15:
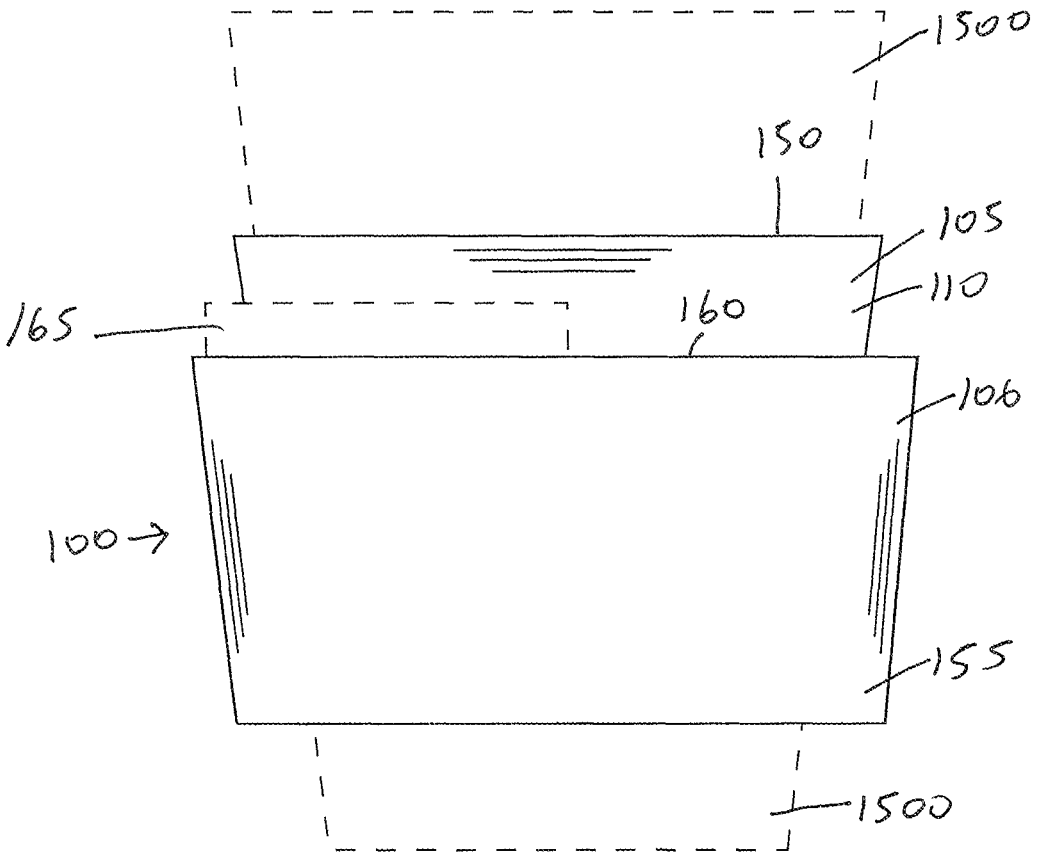
FIG. 15 is another side elevational view of an apparatus, in accordance with an embodiment of the invention.

FIG. 15 is another side elevational view of an apparatus 100, in accordance with an embodiment of the invention. A cup 1500 is removably inserted and removably secured in the first sleeve body opening 130 of the first sleeve body 105 of cup sleeve 100 in this left side elevational view of the cup sleeve 100. The cup 1500 extends from the top opening portion 1100 (FIG. 11) and also extends from the bottom opening portion 1300 (FIG. 13). The object 165 is also removably inserted into and removably secured in the pocket opening 162 of the cup sleeve 100.

Figure 16:
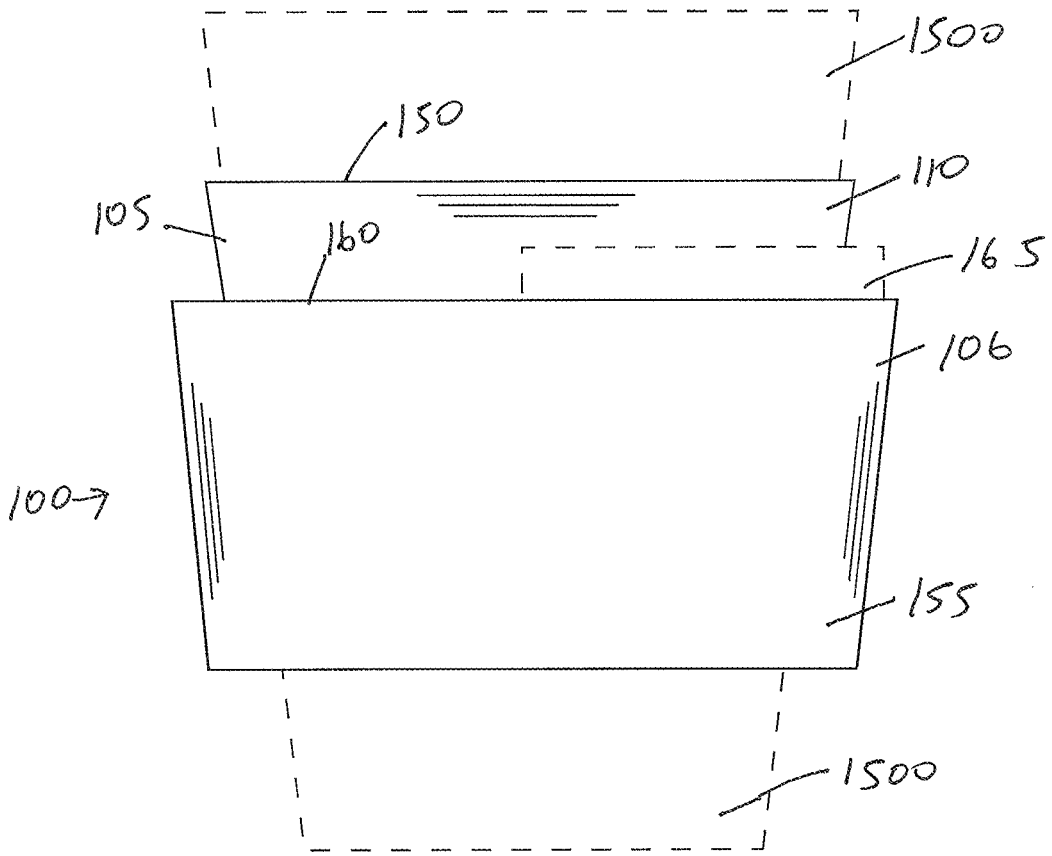
FIG. 16 is another side elevational view of an apparatus, in accordance with an embodiment of the invention.

FIG. 16 is another side elevational view of an apparatus 100, in accordance with an embodiment of the invention. A cup 1500 is removably inserted and removably secured in the first sleeve body opening 130 of the first sleeve body 105 of the cup sleeve 100 in this right side elevational view of the cup sleeve 100. The object 165 is also removably inserted into and removably secured in the pocket opening 162 of the cup sleeve 100.

Figure 17:
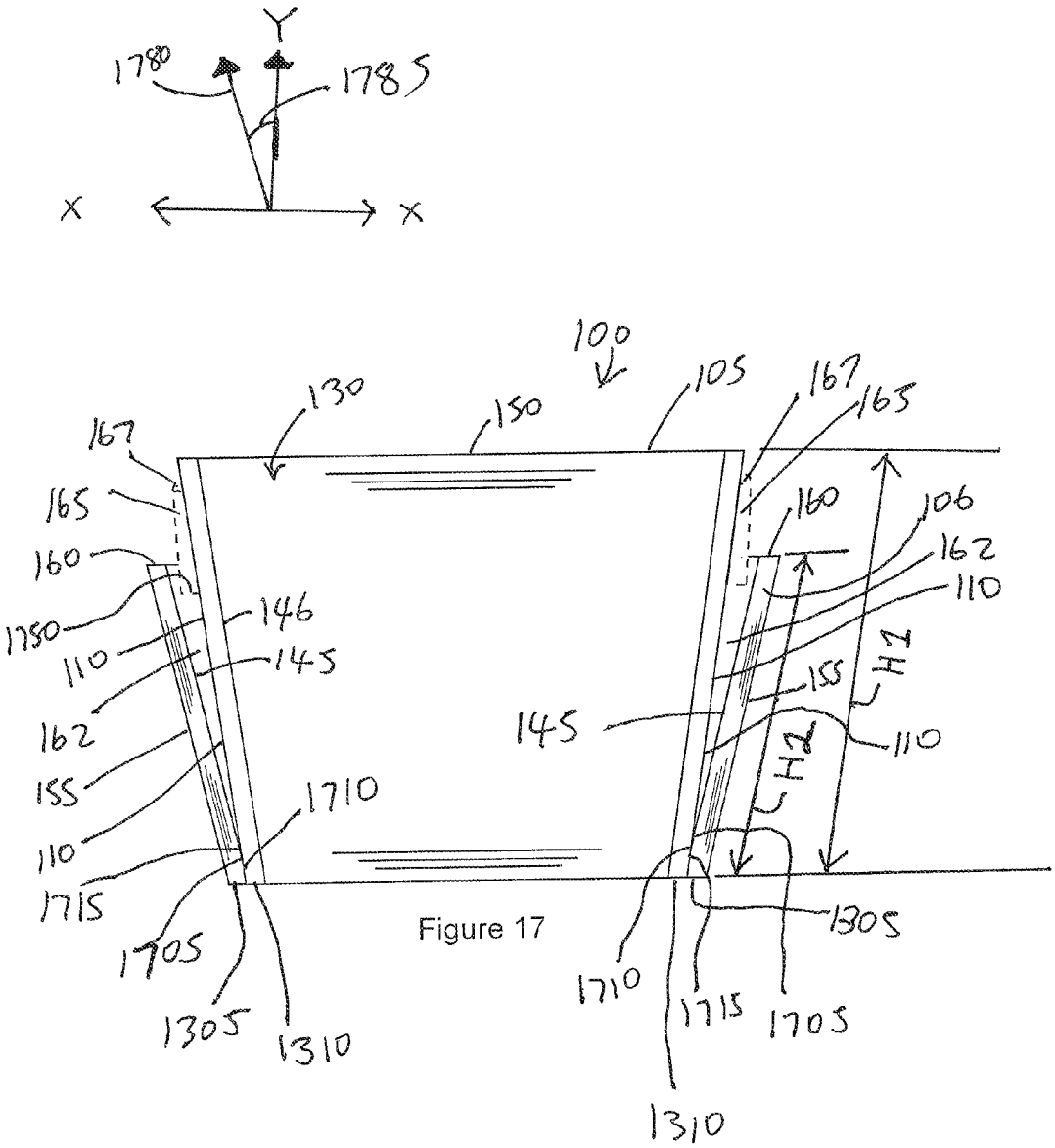
FIG. 17 is a cross sectional side elevational view of an apparatus, in accordance with an embodiment of the invention.
Figure 18:
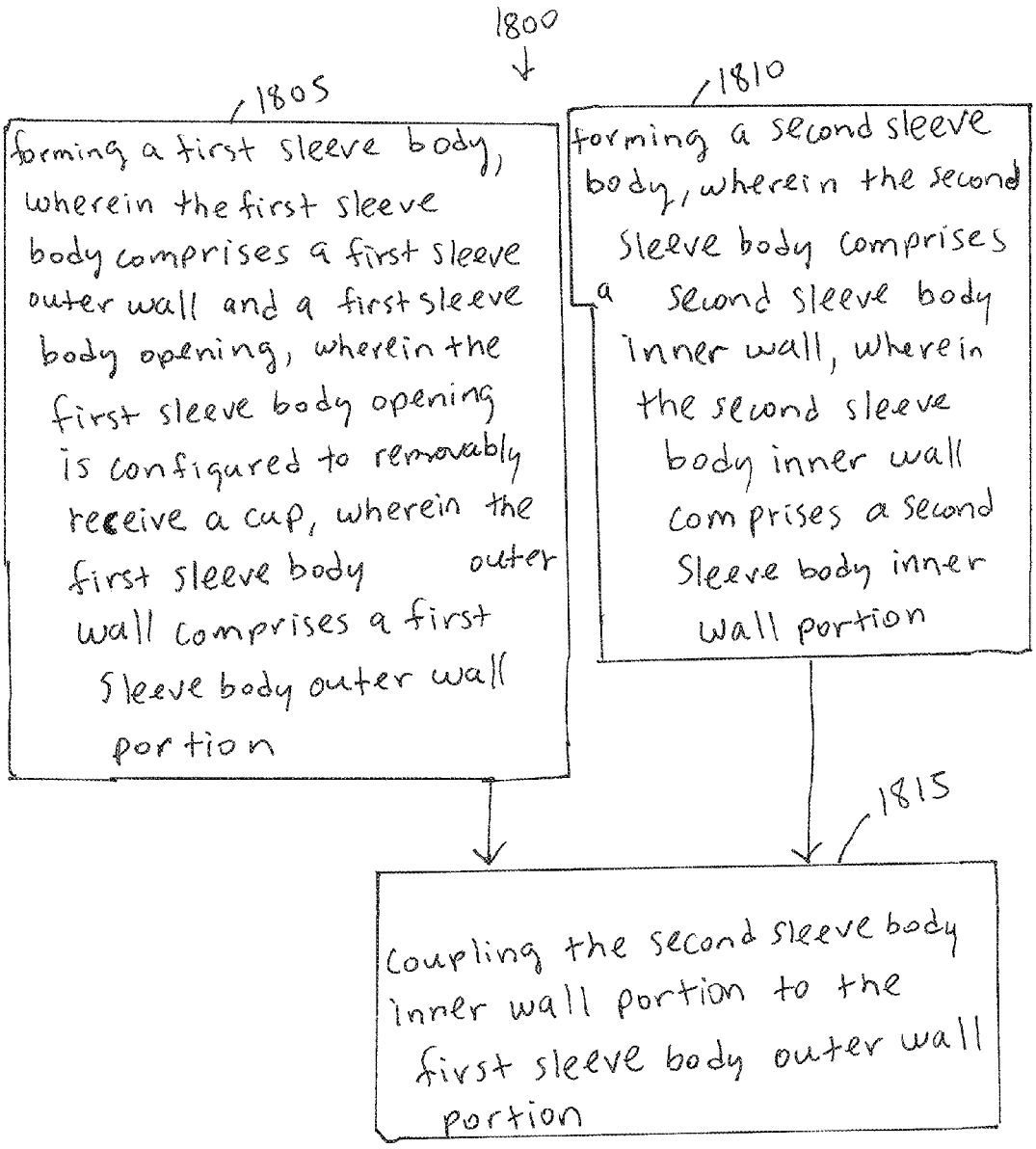
FIG. 18 is a flow diagram of a method of assembling an apparatus, in accordance with an embodiment of the invention.

FIG. 17 is a cross sectional side elevational view of an apparatus 100, in accordance with an embodiment of the invention. This cross sectional view is a view of the apparatus 100 as seen from the top of the reference line A-A of FIG. 14. The object 165 is also removably inserted into and removably secured in the pocket opening 162. The object 165 is removably disposed between the first sleeve body outer wall 110 and second sleeve body inner wall 145. The object 165 is disposed partly in the pocket opening 162 so that the top edge 167 of the object 165 is external from the pocket opening 162. The bottom edge 1750 of the object 165 is facing (or is opposite to or is adjacent to) the intersection area 1715.

In an embodiment of the invention, the second sleeve body 106 comprises a rigid material (e.g., a rigid paper material or carton) so the second sleeve body will not bend and will remain in a direction 1780 with respect to a vertical reference axis Y and a horizontal reference axis X, wherein the axis Y is perpendicular to the axis X. The direction 1780 can vary in an angle 1785 wherein the angle 1785 is measured from the axis Y. In an embodiment of the invention, the angle 1785 can vary in values from about 1 degree to about 30 degrees and the direction 1780 can shift between the various values of the angle 1785. In another embodiment of the invention, the angle 1785 can vary in values from about 1 degrees to about 20 degrees and the direction 1780 can shift between the various values of the angle 1785. In another embodiment of the invention, the angle 1785 can vary in values from about 1 degree to about 15 degrees and the direction 1780 can shift between the various values of the angle 1785. In another embodiment of the invention, the angle 1785 can vary in values from about 1 degree to about 10 degrees and the direction 1780 can shift between the various values of the angle 1785. In another embodiment of the invention, the angle 1785 can vary in values from about 1 degree to about 10 degrees and the direction 1780 can shift between the various values of the angle 1785. In another embodiment of the invention, the angle 1785 can vary in values from about 1 degrees to about 5 degrees and the direction 1780 can shift between the various values of the angle 1785. The angle 1785 has an angular value that permits the object 165 to be removably inserted into and removably secured within the pocket opening 162 and that permits the object 165 to be removed from and extended away from the pocket opening 162.

FIG. 1800 is a flow diagram of a method 1800 of assembling (or a method 1800 of manufacturing) an apparatus 100, in accordance with an embodiment of the invention.

The method 1800 comprises: at 1805, forming a first sleeve body, wherein the first sleeve body comprises a first sleeve body outer wall and a first sleeve body opening, wherein the first sleeve body opening is configured to removably receive a cup, wherein the first sleeve body outer wall comprises a first sleeve body outer wall portion.

The method 1800 further comprises: at 1810, forming a second sleeve body, wherein the second sleeve body comprises a second sleeve body inner wall, wherein the second sleeve body inner wall comprises a second sleeve body inner wall portion.

The method 1800 further comprises: at 1815, coupling the second sleeve body inner wall portion to the first sleeve body outer wall portion.

The steps at 1805 and 1810 can be performed concurrently wherein the steps 1805 and 21810 can be performed at the same time, or can be performed in sequence wherein step 1805 can be performed before step 1810 or step 1810 can be performed before step 1805.

In an embodiment of the invention, a pocketed coffee sleeve comprises a circular pocket that organizes sweeteners, napkins, paper note reminders, and business cards. This pocketed coffee sleeve fits over hot disposable cups of coffee, tea, hot chocolate, and soup. The pocketed coffee sleeve comprises an extra layer of material (shown as an outer sleeve 106 or second sleeve body 106 that is around or that surrounds the inner sleeve 105 or first sleeve body 105) that forms a pocket that goes completely around the sleeve 105 itself. This pocket acts as extra insulation from heat for users. This pocketed coffee sleeve functions as a mobile coffee station and office organizer and holds necessities such as, for example, sweeteners, napkins, stir sticks, paper note reminders, and business cards. Using the pocketed coffee sleeve cuts down on wasted napkins and condiments at coffee serving areas in offices and coffee shops, while allowing the coffee sleeve user the convenience of having important business cards and paper note reminders close at hand.

The pocketed coffee sleeve 100 provides at least the following features: Holds sweeteners and dry creamer packets, saving valuable time; Has an extra layer of insulation to guard against heat; Keeps napkins and stir sticks close at hand; Holds business cards and notes; Allows coffee vendors to serve condiments directly with the coffee; and Will cut down on coffee service station waste. Therefore, this new pocketed coffee sleeve with a pocket holds sugar packets and napkins securely for on-the-go lifestyles, gives customers added insulation against heat, and saves shop owners money. Additionally, this new pocketed coffee sleeve provides users two layers of insulation against heat instead of the one layer offered by common cup holders used in coffee shops today and/or provides double the insulation of today's coffee sleeves. This new pocketed coffee sleeve with a pocket holds sugar packets and napkins securely for on-the-go lifestyles, gives customers added insulation against heat, and saves shop owners money.

Foregoing described embodiments of the invention are provided as illustrations and descriptions. They are not intended to limit the invention to precise form described. In particular, it is contemplated that functional implementation of the invention described herein may be implemented equivalently by other embodiments in light of the teaching discussed herein.

Other variations and modifications of the above-described embodiments and methods are possible in light of the teaching discussed herein.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. An apparatus, comprising:

a first sleeve body;

a second sleeve body;

wherein the first sleeve body comprises a first sleeve body outer wall and a first sleeve body opening, wherein the first sleeve body opening is configured to removably receive a cup;

wherein the first sleeve body outer wall comprises a first sleeve body outer wall portion;

wherein the second sleeve body comprises a second sleeve body inner wall;

wherein the second sleeve body inner wall comprises a second sleeve body inner wall portion;

wherein the second sleeve body inner wall portion is coupled to the first sleeve body outer wall portion;

wherein the second sleeve body inner wall and the first sleeve body outer wall form a pocket for removably receiving an object;

wherein the pocket is disposed between a second sleeve body top edge of the second sleeve body and an intersection area;

wherein the first sleeve body outer wall portion and the second sleeve body inner wall portion are coupled together at the intersection area;

wherein the pocket is concentric to the first sleeve body outer wall and the second sleeve body inner wall;

wherein the pocket extends in a circumference around the first sleeve body outer wall, and wherein the pocket goes completely around the first sleeve body;

wherein the second sleeve body comprises a rigid material;

wherein the second sleeve body is at a direction with respect to a vertical reference axis Y and a horizontal reference axis X and wherein the axis Y is perpendicular to the axis X;

wherein the second sleeve body is at the direction that can vary in an angle that is measured from the axis Y;

wherein the angle can vary in angular values to permit the object to be removably inserted into the pocket and removably secured within the pocket and to permit the object to be removed from and extended away from the pocket; and wherein the object may be disposed partly in the pocket so that a top edge of the object is external from the pocket.

2. The apparatus of claim 1, wherein the object comprises a napkin.

3. The apparatus of claim 1, wherein the first sleeve body comprises a first height and the second sleeve body comprises a second height, and wherein the first height and second height are equal.

4. The apparatus of claim 1, wherein the first sleeve body comprises a first height and the second sleeve body comprises a second height, and wherein the first height is greater than the second height.

5. A method, comprising:

forming a first sleeve body;

forming a second sleeve body;

wherein the first sleeve body comprises a first sleeve body outer wall and a first sleeve body opening, wherein the first sleeve body opening is configured to removably receive a cup;

wherein the first sleeve body outer wall comprises a first sleeve body outer wall portion;

wherein the second sleeve body comprises a second sleeve body inner wall;

wherein the second sleeve body inner wall comprises a second sleeve body inner wall portion;

coupling the second sleeve body inner wall portion to the first sleeve body outer wall portion;

wherein the second sleeve body inner wall and the first sleeve body outer wall form a pocket for removably receiving an object;

wherein the pocket is disposed between a second sleeve body top edge of the second sleeve body and an intersection area;

wherein the first sleeve body outer wall portion and the second sleeve body inner wall portion are coupled together at the intersection area;

wherein the pocket is concentric to the first sleeve body outer wall and the second sleeve body inner wall;

wherein the pocket extends in a circumference around the first sleeve body outer wall, and wherein the pocket goes completely around the first sleeve body;

wherein the second sleeve body comprises a rigid material;

wherein the second sleeve body is at a direction with respect to a vertical reference axis Y and a horizontal reference axis X and wherein the axis Y is perpendicular to the axis X;

wherein the second sleeve body is at the direction that can vary in an angle that is measured from the axis Y;

wherein the angle can vary in angular values to permit the object to be removably inserted into the pocket and removably secured within the pocket and to permit the object to be removed from and extended away from the pocket; and wherein the object may be disposed partly in the pocket so that a top edge of the object is external from the pocket.

6. The method of claim 5, wherein the object comprises a napkin.

7. The method of claim 5, wherein the first sleeve body comprises a first height and the second sleeve body comprises a second height, and wherein the first height and second height are equal.

8. The method of claim 5, wherein the first sleeve body comprises a first height and the second sleeve body comprises a second height, and wherein the first height is greater than the second height.

* * * * *